US011454085B2

(12) United States Patent
Hrupp

(10) Patent No.: US 11,454,085 B2
(45) Date of Patent: Sep. 27, 2022

(54) CASED BORE STRADDLE PACKER

(71) Applicant: Exacta-Frac Energy Services, Inc., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 13 days.

(21) Appl. No.: 17/147,924

(22) Filed: Jan. 13, 2021

(65) Prior Publication Data

US 2021/0156218 A1 May 27, 2021

Related U.S. Application Data

(63) Continuation of application No. 16/197,573, filed on Nov. 21, 2018, now Pat. No. 10,900,319.

(60) Provisional application No. 62/598,572, filed on Dec. 14, 2017.

(51) Int. Cl.

| | |
|---|---|
| ***E21B 33/124*** | (2006.01) |
| ***E21B 33/128*** | (2006.01) |
| ***E21B 23/00*** | (2006.01) |
| ***E21B 43/26*** | (2006.01) |
| ***E21B 23/04*** | (2006.01) |
| ***E21B 23/06*** | (2006.01) |

(52) U.S. Cl.

CPC ..... *E21B 33/124* (2013.01); *E21B 23/006* (2013.01); *E21B 23/04* (2013.01); *E21B 23/06* (2013.01); *E21B 43/26* (2013.01)

(58) Field of Classification Search

CPC .... E21B 33/122; E21B 33/124; E21B 33/128; E21B 33/1285

See application file for complete search history.

(56) References Cited

U.S. PATENT DOCUMENTS

| | | | | |
|---|---|---|---|---|
| 2,715,444 | A * | 8/1955 | Fewel | E21B 33/124 277/342 |
| 2,769,497 | A | 11/1956 | Reistle, Jr. | |
| 2,927,638 | A | 3/1960 | Hall, Sr. | |
| 2,947,520 | A | 8/1960 | Tappmeyer | |
| 3,090,436 | A | 5/1963 | Briggs, Jr. | |
| 3,530,948 | A | 9/1970 | Garrett | |
| 4,590,995 | A | 5/1986 | Evans | |
| 5,383,520 | A | 1/1995 | Tucker et al. | |
| 5,803,177 | A | 9/1998 | Hriscu et al. | |
| 5,890,540 | A | 4/1999 | Pia et al. | |
| 6,253,856 | B1 | 7/2001 | Ingram et al. | |
| 6,394,184 | B2 | 5/2002 | Tolman et al. | |
| 6,484,805 | B1 | 11/2002 | Perkins et al. | |

(Continued)

*Primary Examiner* — Kenneth L Thompson

(74) *Attorney, Agent, or Firm* — JK Intellectual Property Law, PA

(57) ABSTRACT

A cased bore straddle packer has an upper unload sub sleeve with fluid ports that are selectively aligned with corresponding ports in an upper unload sub mandrel component and a lower unload sub sleeve with fluid ports that are selectively aligned with corresponding ports in a lower unload sub mandrel component to permit fluid to be selectively dumped from the straddle packer. Control of the alignment of the respective ports is effected by manipulating an auto-J ratchet machined into a multicomponent mandrel of the straddle packer. The auto-J ratchet is controlled from the surface using completion string pull and push manipulations.

20 Claims, 5 Drawing Sheets

(56) References Cited

U.S. PATENT DOCUMENTS

| | | | | |
|---|---|---|---|---|
| 6,655,461 | B2 | 12/2003 | Eslinger | |
| 6,776,239 | B2 | 8/2004 | Elsinger et al. | |
| 6,832,654 | B2 | 12/2004 | Ravensburger et al. | |
| 6,883,610 | B2 | 4/2005 | Depaik | |
| 7,377,834 | B2 | 3/2008 | Surjaatmadja et al. | |
| 7,500,526 | B2 | 3/2009 | Telfer | |
| 7,789,163 | B2 | 9/2010 | Kratochvil et al. | |
| 8,201,631 | B2 | 6/2012 | Stromquist et al. | |
| 8,338,615 | B2 | 12/2012 | Hughes et al. | |
| 8,490,702 | B2 | 7/2013 | Stromquist et al. | |
| 9,016,390 | B2 | 4/2015 | Stewart et al. | |
| 9,291,044 | B2 | 3/2016 | Murphy | |
| 9,334,714 | B2 | 5/2016 | Stromquist et al. | |
| 9,359,854 | B2 * | 6/2016 | Hughes | E21B 34/08 |
| 9,580,990 | B2 | 2/2017 | Flores et al. | |
| 9,598,939 | B2 | 3/2017 | Lee | |
| 10,119,376 | B2 * | 11/2018 | Eleven | E21B 43/25 |
| 10,584,555 | B2 * | 3/2020 | Leonardi | E21B 43/261 |
| 10,584,558 | B2 * | 3/2020 | Manke | E21B 34/08 |
| 10,900,319 | B2 * | 1/2021 | Hrupp | E21B 23/04 |
| 11,035,189 | B2 * | 6/2021 | Hrupp | E21B 23/06 |
| 2005/0077053 | A1 | 4/2005 | Walker et al. | |
| 2007/0034370 | A1 | 2/2007 | Moyes | |
| 2015/0376979 | A1 | 12/2015 | Mitchell et al. | |
| 2016/0369585 | A1 | 12/2016 | Limb et al. | |

* cited by examiner

CASED BORE STRADDLE PACKER

RELATED APPLICATIONS

This application is a continuation of U.S. patent application Ser. No. 16/197,573 filed Nov. 21, 2018, which claims the benefit of priority from U.S. provisional application No. 62/598,572 filed Dec. 14, 2017.

FIELD OF THE INVENTION

This invention relates in general to precision fracking systems and, in particular, to a novel cased bore straddle packer.

BACKGROUND OF THE INVENTION

Wellbore pressure isolation tools, commonly referred to as "straddle packers", are known and used to pressure isolate a downhole area of interest in a hydrocarbon wellbore for the purpose of what is known as focused or precision well stimulation, commonly referred to as "precision tracking" or "focused fracking". Straddle packers are well known but not widely used because their use has been associated with issues that render them unreliable and/or costly to retrieve if they become "stuck in the hole".

There therefore exists a need for a novel cased bore straddle packer that overcomes the issues associated with the prior art tools in the same class.

SUMMARY OF THE INVENTION

It is therefore an object of the invention to provide a cased bore straddle packer that overcomes the shortcomings of prior art cased bore straddle packers.

The invention therefore provides a cased bore straddle packer with a fluid pressure boosted packer set, comprising: a multicomponent mandrel that extends from an upper end to a lower end of the cased bore straddle packer, the multicomponent mandrel having a completion string connection mandrel component at an upper end of the straddle packer to permit the connection of a completion tubing string to the straddle packer; an upper packer element and a lower packer element that respectively surround the multicomponent mandrel at each end of a flow activation sleeve of the straddle packer; an upper compression sleeve above the upper packer element, the upper compression sleeve being adapted to reciprocate over an upper packer element compression piston mandrel component of the multicomponent mandrel, and a lower compression sleeve below the lower packer element, the lower compression sleeve being adapted to slide over a lower packer element compression piston mandrel component of the multicomponent mandrel; an auto-j ratchet having straddle packer fluid-unload positions, in which the upper and lower packer elements are in relaxed conditions, interleaved with straddle packer set positions, in which the lower packer element is in an initial set condition; a set of mechanical slips below the lower packer element, the mechanical slips engaging a casing of the cased wellbore when the auto-j ratchet is moved to a straddle packer initial set position; a set of drag blocks below the mechanical slips to engage the casing and provide frictional resistance to movement of the straddle packer, to permit the multicomponent mandrel to be moved from the fluid-unload position to the initial set position; fluid passages through a sidewall of the flow activation mandrel component, the upper piston mandrel component and the lower piston mandrel component which respectively permit fluid pumped through the completion tubing string to exit through the ports in the flow activation sleeve, and to flow into piston chambers of the respective compression sleeves to drive the respective compression sleeves against the respective upper and lower packer elements to boost compression of the respective upper and lower packer elements; and fluid passages through a sidewall of an upper unload sub mandrel component above the upper packer element and a lower unload sub mandrel component below the lower packer element to permit fluid pumped through the completion tubing string to flow into an annulus of the cased wellbore through ports in an upper unload sub sleeve and a lower unload sub sleeve when the multicomponent mandrel of the straddle packer is moved to the fluid-unload position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
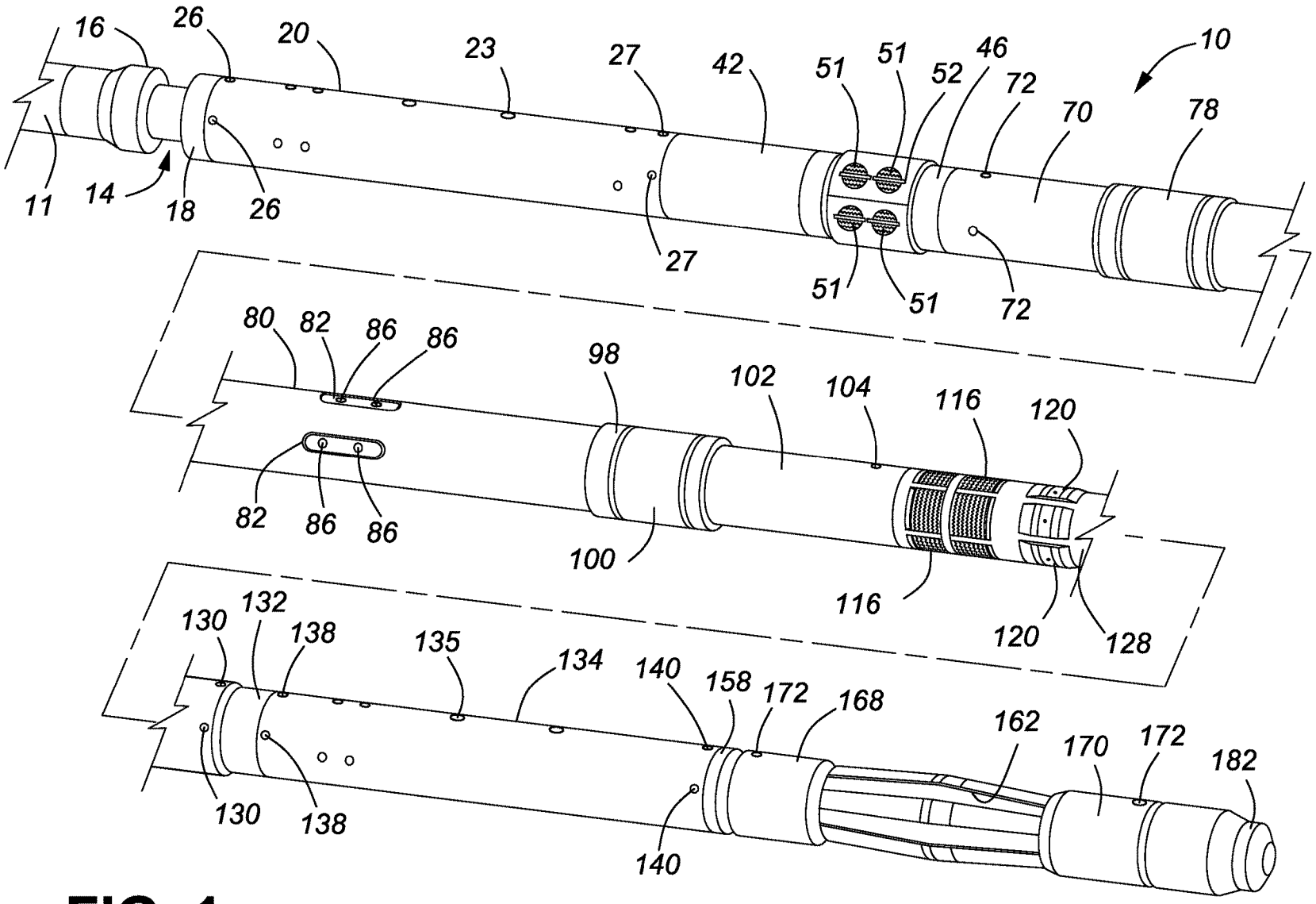
FIG. 1 is a perspective view of one embodiment of a straddle packer with fluid pressure boosted packer set in accordance with the invention.

The invention provides a cased wellbore straddle packer with a fluid pressure boosted packer set. The straddle packer has spaced-apart upper and lower packer elements that bracket fluid ports in a flow activation sleeve of the straddle packer. The fluid ports in the flow activation sleeve permit high-pressure frac fluid to be pumped through a completion string connected to the straddle packer and into a section of the cased wellbore isolated by the respective spaced-apart upper and lower packer elements. An auto-j ratchet retains a multicomponent mandrel of the straddle packer in a fluid-unload position while the straddle packer is run into a cased or open well bore. The straddle packer may be run into the well bore using a coil tubing or jointed tubing completion string. The straddle packer is run into the wellbore against the frictional resistance of drag blocks provided below the lower packer element.

A collar locator on a bottom end of the straddle packer permits the operator to detect casing collars in a cased well bore to track the straddle packer location in the cased well bore. Once a desired location in the cased wellbore has been reached, the completion tubing string is pulled up to activate an auto-j ratchet and release the multicomponent mandrel of the straddle packer from the fluid-unload position. After the auto-j ratchet has been activated, the multicomponent mandrel can be moved into an initial packer set position. A completion string compression weight of around 10,000 pounds, for example, is then applied at the surface to the completion string. The completion string compression weight slides the multicomponent mandrel downward through the straddle packer to deploy mechanical slips below the lower packer element. On deployment, the mechanical slips are forced outwardly and engage the casing to lock the straddle packer in the desired location. The movement of the multicomponent mandrel and the compression weight on the completion tubing string also compresses the upper and lower packer elements to provide an initial fluid seal between the straddle packer and the cased well bore around the fluid ports in the flow activation sleeve. High-pressure fluid is then pumped down the completion string. The high-pressure fluid flows through fluid ports in the flow activation sleeve into the cased well bore. The high-pressure fluid also flows through hydraulic slip pressure ports and sets hydraulic slips located above the upper packer element to further anchor the straddle packer in the cased wellbore. The high-pressure fluid likewise flows through upper and lower pressure boost piston ports which drives upper and lower compression sleeves against the respective upper and lower packer elements to further compress the respective upper and lower packer elements and boost the respective upper and lower packer element seals. As the fluid pressure rises, the compressive force applied to the respective upper and lower packer elements by the respective upper and lower compression sleeves increases correspondingly. Consequently, the higher the frac fluid pressure, the greater the boost pressure on the respective packer element seals and the more secure those seals become.

In the event of a screen-out in which proppant backs up and fills the straddle packer, an upper unloader sub above the upper packer element and a lower unloader sub below the lower packer element can be respectively activated by releasing the pump pressure on the completion string. This permits the hydraulic slips to unset. The completion tubing string is then pulled up to slide the multicomponent mandrel back from the straddle packer set position to the straddle packer fluid-unload position. In the straddle packer fluid-unload position, fluid ports in respective upper and lower unloader sub mandrel components of the multicomponent mandrel are in fluid communication with the cased well bore. This permits clean fluid to be pumped down the completion tubing string and circulated through the straddle packer and into the annulus of the cased wellbore. Circulating the clean fluid permits any frac proppant trapped in and around the straddle packer to be flushed out of the cased wellbore to free up the straddle packer and permit it to be moved to a next location of interest, or pulled out of the wellbore.

| Part No. | Part Description |
|---|---|
| 10 | Straddle packer |
| 11 | Completion string |
| 12 | Well bore casing |
| 14 | Multicomponent mandrel |
| 16 | Completion string connection mandrel component |
| 18 | Upper end sleeve |
| 20 | Upper unload sub sleeve |
| 22 | Upper unload sub mandrel component |
| 23 | Upper unload sub mandrel ports |
| 24 | High-pressure fluid seals |
| 26 | Cap screws |
| 27 | Cap screws |
| 28a, 28b | Anti-rotation slots |
| 30a, 30b | Anti-rotation lugs |
| 32 | High-pressure fluid seal |

-continued

| Part No. | Part Description |
|---|---|
| 34 | Captive seal |
| 36 | Captive seal retainer ring |
| 38 | High-pressure fluid seal |
| 40 | High-pressure fluid seal seat ring |
| 42 | Tandem sub |
| 44 | High-pressure fluid seal |
| 46 | Hydraulic slip sub |
| 47 | Upper packer element mandrel component |
| 48 | High-pressure fluid seal |
| 50 | High-pressure fluid seal |
| 51 | Hydraulic slips |
| 52 | Hydraulic slip retainer plates |
| 54 | Hydraulic slip retainer plate screws |
| 56 | Hydraulic slip pressure ports |
| 58 | Hydraulic slip spring assemblies |
| 60 | High-pressure fluid seal |
| 62 | High-pressure fluid seal |
| 64 | High-pressure fluid seal |
| 66 | High-pressure fluid seal |
| 70 | Upper packer element compression sleeve |
| 72 | Upper packer element compression sleeve pressure balance ports |
| 73 | Upper packer element compression piston |
| 74 | Upper packer element compression piston seal |
| 75 | Upper packer element piston chamber |
| 76 | Upper packer element piston ports |
| 77 | High-pressure fluid seal |
| 78 | Upper packer element |
| 80 | Flow activation sleeve |
| 82 | Flow activation sleeve ports |
| 84 | Flow activation mandrel component |
| 86 | Flow activation mandrel ports |
| 88 | High-pressure fluid seal |
| 90 | High-pressure fluid seal |
| 92 | High-pressure fluid seal |
| 94 | High-pressure fluid seal |
| 96 | Initial set sub mandrel component |
| 98 | Floating packer element compression ring |
| 100 | Lower packer element |
| 102 | Lower packer element compression sleeve |
| 104 | Lower compression sleeve pressure balance ports |
| 105 | High-pressure fluid seal |
| 106 | Lower packer element piston ports |
| 108 | Lower packer element piston mandrel component |
| 109 | Lower packer element piston |
| 110 | Lower packer element piston seal |
| 112 | Lower packer element piston chamber |
| 114 | High-pressure fluid seal |
| 116 | Mechanical slips |
| 118 | Mechanical slip springs |
| 120 | Drag blocks |
| 122 | Drag block bow springs |
| 124 | Auto-j ratchet lug |
| 126 | Auto-j ratchet groove |
| 126a | Auto-j ratchet neutral notch |
| 126b | Auto-j ratchet slip engage notch |
| 126c | Auto-j ratchet shift notch |
| 127 | Drag block/slip sub |
| 128 | Drag block/slip retainer ring |
| 130 | Drag block/slip retainer screws |
| 132 | Lower tandem sub |
| 134 | Lower unload sub sleeve |
| 135 | Lower unload sub sleeve ports |
| 136 | Lower unload sub mandrel component |
| 137 | Lower unload sub mandrel ports |
| 138 | Cap screws |
| 140 | Cap screws |
| 142 | High-pressure fluid seal |
| 144a, b | Lower anti-rotation slots |
| 146a, b | Lower anti-rotation lugs |
| 148 | High-pressure fluid seal |
| 150 | Captive seal |
| 152 | Captive seal ring |
| 154 | High-pressure fluid seal |
| 156 | High-pressure fluid seal seat ring |
| 158 | Lower unload sub end cap |
| 160 | High-pressure fluid seal |

-continued

| Part No. | Part Description |
|---|---|
| 161 | Collar locator mandrel component |
| 162 | Collar locator ribs |
| 163 | Collar locator sleeve |
| 164 | Casing collar |
| 166 | Collar locator hooks |
| 168 | Upper collar locator retainer ring |
| 170 | Lower collar locator retainer ring |
| 172 | Collar locator retainer screws |
| 174 | Upper collar locator seal |
| 176 | Upper collar locator seal retainer ring |
| 178 | Lower collar locator seal |
| 180 | Lower collar locator seal retainer ring |
| 182 | Straddle packer guide cap |
| 184 | Casing perforations |

FIG. 1 is a perspective view of an embodiment of the straddle packer 10 with fluid pressure boosted packer set in accordance with the invention. In this embodiment, the straddle packer 10 includes a multicomponent mandrel 14, which will be explained below in more detail with reference to FIG. 2. A completion string connection mandrel component 16 is connected to an uphole end of the multicomponent mandrel 14 for the connection of a completion string 11, also referred to as a "work string", to the straddle packer 10. An internal configuration of the completion string connection mandrel component 16 is dependent on a type of completion string 11 to be used to complete a cased well bore which may be a coil tubing completion string or a jointed tubing completion string, each of which are well known in the art. Slideably mounted to the uphole end of the multicomponent mandrel is an upper end sleeve 18 which supports an uphole end of an upper unload sub sleeve 20 that includes a plurality of upper upload sub mandrel ports 23 (only one is shown), the function of which will be explained below with reference to FIG. 3. The upper unload sub sleeve 20 is connected to the upper end sleeve 18 by a plurality of cap screws 26, only two of which are shown. The downhole end of the upper unload sub sleeve 20 is supported by a tandem sub 42 and connected thereto by a plurality of cap screws 27, of which only two are shown. Connected to a downhole end of the tandem sub 42 is a hydraulic slip sub 46, which will be explained below with reference to FIG. 2. The hydraulic slip sub 46 includes a plurality of hydraulic slips 51, respectively retained in the hydraulic slip sub 46 by hydraulic slip retainer plates 52. The hydraulic slip retainer plates are secured by hydraulic slip retainer plate screws 54. Hydraulic slip spring assemblies 58 urge the hydraulic slips 51 (see FIG. 4) to an unset condition seen in this view. Connected to a downhole end of the hydraulic slip sub 46 is an upper packer element compression sleeve 70 having a plurality of upper packer element compression sleeve pressure balance ports 72, the function of which will be explained below with reference to FIGS. 2-4. An upper packer element 78 is compressed by the upper packer element compression sleeve 70 into sealing contact with a well casing, as will be explained below with reference to FIG. 3. On a downhole side of the upper packer element 78 is a flow activation sleeve 80 having a plurality of flow activation sleeve ports 82 above flow activation mandrel ports 86. In one embodiment, there are two flow activation mandrel ports 86, associated with each flow activation sleeve port 82, but this is a matter of design choice.

Downhole of a bottom end of the flow activation sleeve 80 is a floating packer element compression ring 98, which in combination with the flow activation sleeve 80, compresses the upper packer element 78 and a lower packer element 100 to an initial set condition, as will be explained below with reference to FIG. 3. A lower packer element compression sleeve 102, which abuts a downhole end of the lower packer element 100, includes lower compression sleeve pressure balance ports 104, of which only one is shown. At a downhole end of the lower packer element compression sleeve 102 are mechanical slips 116, the function of which will be explained below with reference to FIG. 3. A plurality of drag blocks 120 are secured by a drag block/slip retainer ring 128, the downhole end of which is connected to a lower tandem sub 132 by a plurality of drag block/slip retainer screws 130. A lower unload sub sleeve 134 is connected to a downhole end of the lower tandem sub 132 by a plurality of cap screws 138. A high-pressure fluid seal 142 inhibits fluid intrusion into a downhole end of the lower tandem sub. The lower unload sub sleeve 134 has unload sub sleeve ports 135, only one of which is shown, the function of which will be explained below. A lower end of the lower unload sub sleeve 134 is connected by cap screws 140 to a lower unload sub end cap 158. An upper collar locator retainer ring 168 is connected to an uphole end of a collar locator sleeve 163 (see FIG. 2) by a plurality of collar locator retainer screws 172. The upper collar locator ring 168 captures an upper end of a plurality of collar locator ribs 162. The collar locator ribs 162 are used to locate casing collars in a manner well known in the art. The downhole ends of the collar locator ribs 162 are captured by a lower collar locator ring 170. A downhole end of the lower collar locator ring 170 is connected to the collar locator mandrel component 161 (see FIG. 2) by a plurality of collar locator retainer screws 172. A straddle packer guide cap 182 is threadedly connected to a downhole end of the collar locator sleeve 163.

Figure 2:
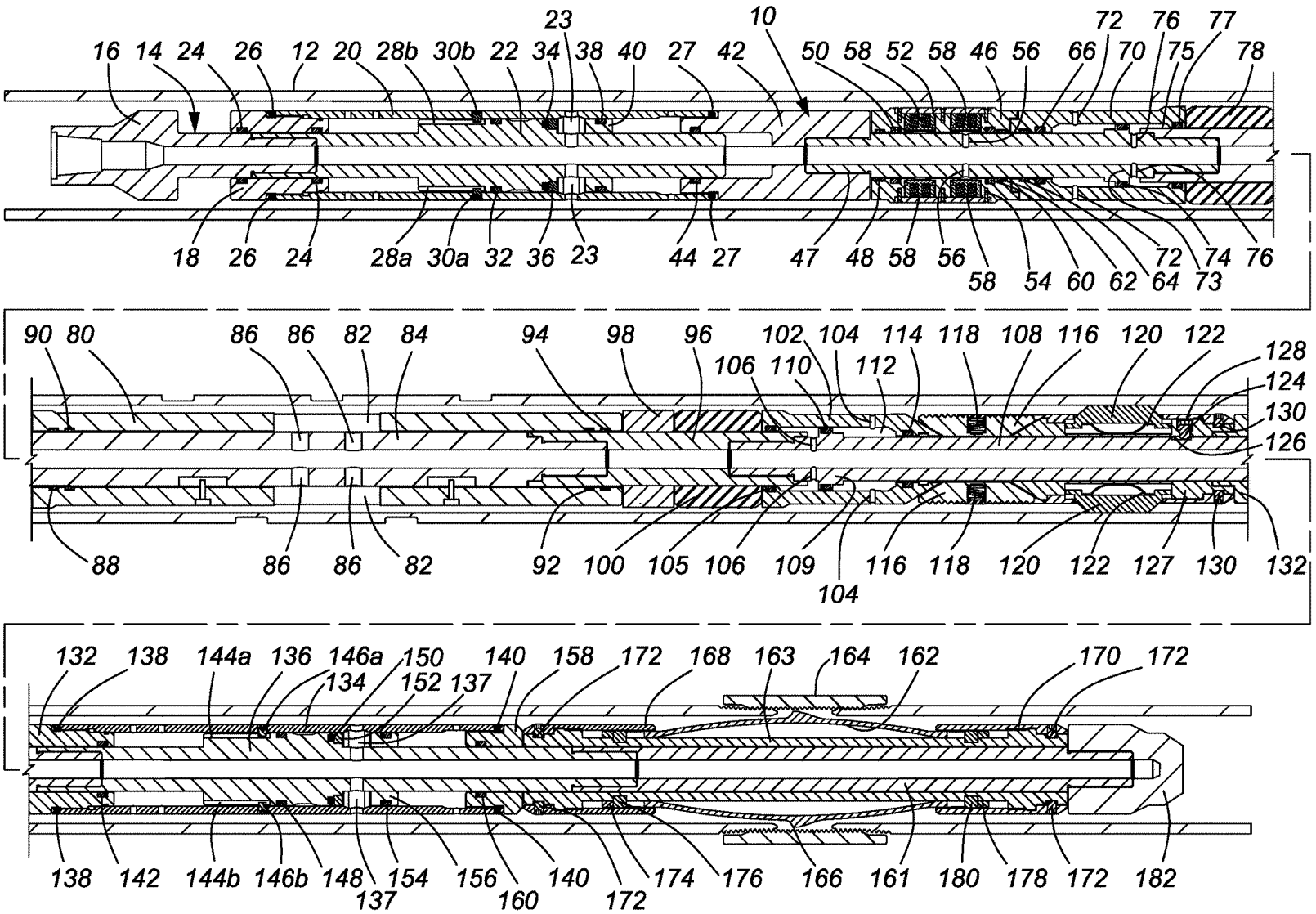
FIG. 2 is a cross-sectional view of the embodiment of the straddle packer shown in FIG. 1 in a fluid-unload condition.

FIG. 2 is a cross-sectional view of one embodiment of the straddle packer 10 shown in FIG. 1 in a fluid-unload condition in which the straddle packer 10 is run into a cased wellbore 12, which may be cased using any commercially available cemented casing system. The external components of the straddle packer 10 were described above with reference to FIG. 1, and that description will not be repeated. Internally the multicomponent mandrel 14 includes the completion string connection mandrel component 16 which is threadedly connected to an upper unload sub mandrel component 22 that reciprocates within the, upper unload sub sleeve 20 from a fluid-unload position (shown) to an initial set position shown in FIG. 3. In the fluid-unload position, the upper unload sub mandrel ports 23 are aligned with corresponding ports in the upper unload sub sleeve 20. The respective mandrel ports 23 are kept in register by anti-rotation lugs 30*a*, 30*b* which inner ends that slide in corresponding anti-rotation slots 28*a*, 28*b*. Fluid seals 24 inhibit an intrusion of fluids between the upper end sleeve 18 and the multicomponent mandrel 14. A high-pressure fluid seal 32 inhibits fluid migration of between the upper unload sub mandrel component 22 and the upper unload sub sleeve 20. A captive seal 34 retained by a captive seal retainer ring 36 inhibits fluid migration from the uphole side of the upper unload sub mandrel ports 23, while a high-pressure fluid seal 38 carried by a high-pressure fluid seal seat ring 40 inhibits fluid migration from the downhole side of the upper unload sub mandrel ports 23. A high-pressure fluid seal 44 inhibits fluid migration around a downhole end of the upper unload sub mandrel component 22.

The downhole end of the upper unload sub mandrel component 22 is slideably received in an uphole end of the tandem sub 42. An upper packer element mandrel component 47 is threadedly connected to a downhole end of the tandem sub 42. A high-pressure fluid seal 48 inhibits fluid migration around an uphole end of the upper packer element mandrel component 47. A high-pressure fluid seal 50 inhibits an uphole migration of fluid that flows into the hydraulic slip sub 46 through hydraulic slip pressure ports 56, and a high-pressure fluid seal 60 inhibits a downhole migration of that fluid, as will be explained below in more detail. A high-pressure fluid seal 62 inhibits fluid migration into a downhole end of the hydraulic slip sub 46. A high-pressure fluid seal 64 inhibits fluid migration into the uphole end of the upper packer element compression sleeve 70, and a high-pressure fluid seal 66 inhibits fluid migration from a backside of an upper packer element compression piston 73. An upper packer element compression piston seal 74 inhibits fluid migration out of an upper packer element piston chamber 75 that receives high-pressure fluid injected through upper packer element piston ports 76. A high-pressure fluid seal 77 inhibits fluid migration around a downhole end of the upper packer element compression sleeve 70.

The upper packer element 78 is carried on an uphole end of a flow activation mandrel component 84 threadedly connected to a downhole end of the upper packer element mandrel component 47. As explained above, the flow activation mandrel component 84 contains a plurality of flow activation mandrel ports 86 through which high-pressure fracturing fluid is pumped into a cased wellbore, as will be explained below in more detail with reference to FIG. 4. Uphole migration of the fracturing fluid is inhibited by high-pressure seals 88 and 90, and downhole migration of the fracturing fluid is inhibited by high-pressure fluid seals 92 and 94. A downhole end of the flow activation mandrel component 84 is threadedly connected to an initial set sub mandrel component 96 which slideably supports the floating packer element compression ring 98, as will be explained below with reference to FIG. 3. The lower packer element 100 is supported by the initial set sub mandrel component 96, A lower packer element piston mandrel component 108 is threadedly connected to a downhole end of the initial set sub mandrel component 96. A high-pressure fluid seal 105 inhibits fluid migration around an uphole end of the lower packer element compression sleeve 102. High-pressure fracturing fluid enters a lower packer element piston chamber 112, defined by a lower packer element piston 109 having a lower packer element piston seal 110, through lower packer element piston ports 106. A high-pressure fluid seal 114 inhibits fluid migration around a downhole end of the lower packer element compression sleeve 102.

The downhole end, of the lower packer element compression sleeve 102 is conical and serves as an uphole slip ramp to set the mechanical slips 116, as will be explained below with reference to FIG. 3. The mechanical slips 116 are normally urged to an unset condition (shown in this view) by mechanical slip springs 118. In this embodiment, the mechanical slip springs 118 are retained by the drag block/slip retainer ring 128, as better seen in FIGS. 5*a* and 5*b*. An uphole end of a drag block/slip sub 127 serves as a downhole slip ramp for setting the mechanical slips 116. The drag block/slip sub 127 also retains the drag blocks 120, which are normally urged into engagement with the well bore casing 12 by drag block bow springs 122 to provide frictional resistance as the straddle packer 10 is run into the cased well bore. The drag block/slip sub 127 also supports an auto-J ratchet lug 124 which cooperates with an auto-J ratchet groove 126 (better seen in FIGS. 5*a* and 5*b*) milled into a downhole end of the lower packer element piston mandrel component 108. The function of the auto-J ratchet will be explained below with reference to FIGS. 3, 5*a* and 5*b* .

Threadedly connected to a downhole end of the drag block/slip sub 127 is the lower tandem sub 132. Threadedly connected to a downhole end of the lower packer element piston mandrel component 108 is a lower unload sub mandrel component 136 having lower unload sub mandrel ports 137, the function of which will be explained below with reference to FIG. 4. Axial rotation of the lower unload sub mandrel component 136 is inhibited by lower anti-rotation slots 144*a*, 144*b* which receive inner ends of lower anti-rotation lugs 146*a*, 146*b*. A high-pressure fluid seal 148 inhibits fluid migration around an uphole end of the lower unload sub mandrel component 136. A captive seal 150 retained by a captive seal ring 152 inhibits fluid migration from an uphole side of the lower unload sub mandrel ports 137. A high-pressure fluid seal 154 carried by a high-pressure fluid seal seat ring 156 threadedly connected to the lower unload sub mandrel component 136 inhibits fluid migration from a downhole side of the lower unload sub mandrel ports 137. A high-pressure fluid seal 160 inhibits fluid migration around an uphole end of the lower unload sub end cap 158. The downhole end of the lower unload sub, mandrel component 136 is threadedly connected to a collar locator mandrel component 161. A collar locator sleeve 163 is slideably received on the collar locator mandrel component 163. A straddle packer guide cap 182 threadedly connected to the downhole end of the collar locator mandrel component 161 retains the collar locator sleeve 163. An upper collar locator ring 168 captures an uphole end of a plurality of collar locator ribs 162. The upper collar locator ring 168 is secured by a plurality of collar locator retainer screws 172. An upper collar locator seal 174 is retained by an upper collar locator seal retainer ring 176. A lower collar locator retainer ring 170 captures the downhole ends of the collar locator ribs 162. A lower collar locator seal 178 is retained by a lower collar locator seal retainer ring 180. As is well understood by those skilled in the art, the collar locator ribs have respective collar locator hooks 166 which "catch" an end of a casing joint as the straddle packer 10 is pulled uphole and the collar locator hooks 166 pass through a casing collar 164. The catch on the end of the uphole casing joint is detectable on the surface as a spike in string weight on an operator's string weight gauge, alerts the operator that a collar 164 in the casing string has been located.

Figure 3:
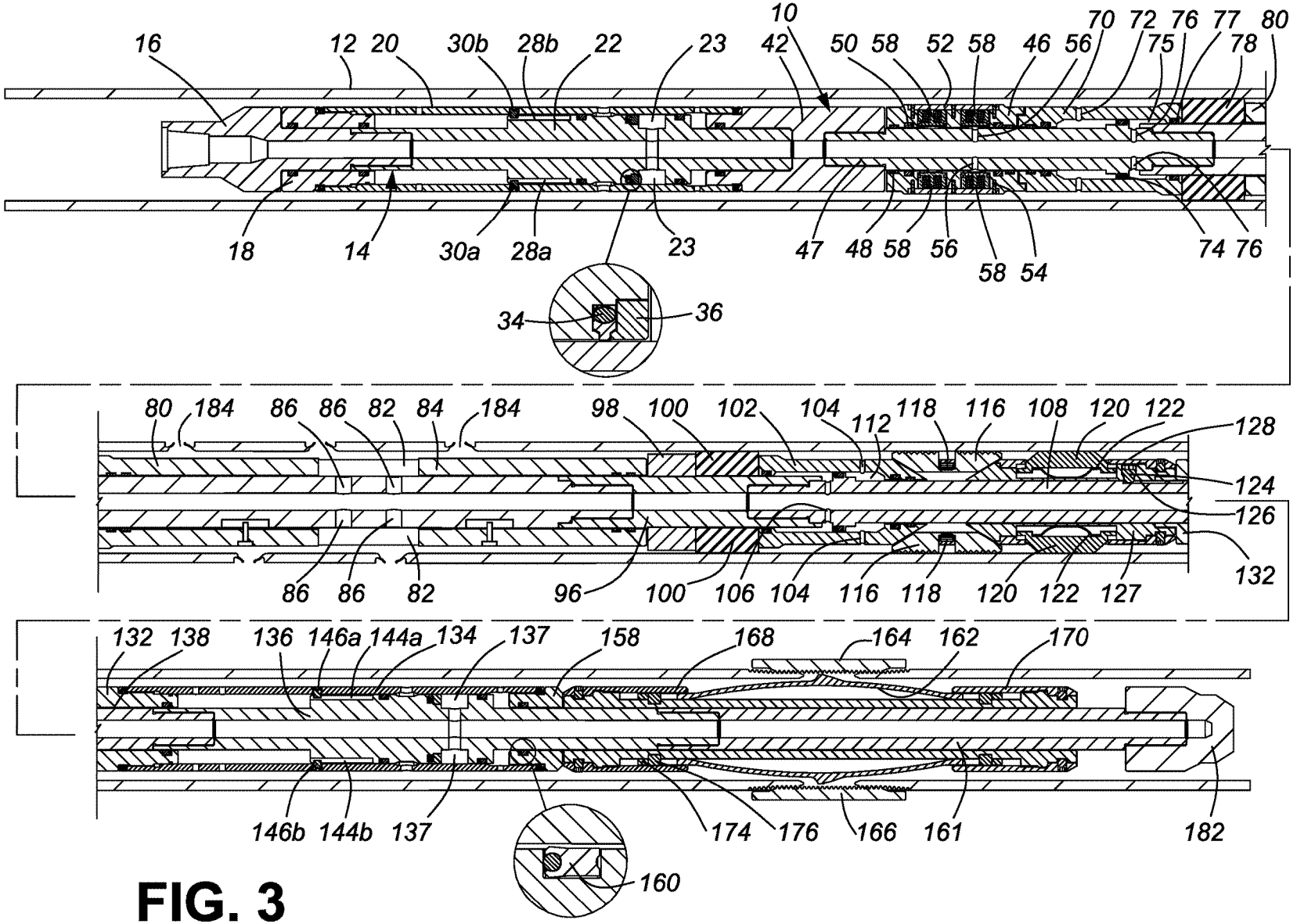
FIG. 3 is a cross-sectional view of the embodiment of a straddle packer shown in FIG. 1 in an initial set condition.

FIG. 3 is a cross-sectional view of one embodiment of the straddle packer 10 shown in FIG. 1 in the initial set condition. After the straddle packer 10 has been moved to a desired location in a wellbore using, for example, the collar locator described above and dead reckoning, or any other tool positioning method or apparatus, the straddle packer 10 is placed in an initial set condition preparatory to isolating a section of the wellbore for focused fracturing. To place the straddle packer 10 in the initial-set condition after it has moved to the desired location in the well bore, the operator pulls up on the completion string which shifts the auto-J ratchet 126 (as will be explained below in more detail with reference to FIGS. 5*a* and 5*b*) from the auto-J ratchet neutral notch 126*a* (see FIG. 5*a*), used to run the straddle packer 10 into the well bore and relocate it within the well bore, to an auto-J ratchet shift notch 126*c* (see FIG. 5*a*). The operator then pushes the completion string back down the well bore, which shifts the auto-J ratchet from the auto-J ratchet shift notch 126*c* to an auto-J ratchet slip engage, notch 126*b* (see FIG. 5*b*), and the auto-J ratchet lug 124 begins to slide down the auto-J ratchet slip engage notch 126*b*. This frees the multicomponent mandrel 14 to slide downhole through the straddle packer 10 for a length of the slip engage notch 126*b*. As the operator pushes the completion string downhole, the straddle packer 10 is urged downhole against the resistance of the drag blocks 120. This slides the upper unload sub mandrel component 22 downwardly until the completion string connection mandrel component 16 contacts the upper end sleeve 18, closing the upper unload sub ports 23. Then the entire portion of the straddle packer 10 above the mechanical slips 116 is forced downhole, driving the mechanical slips 116 up the slip ramps on the lower packer element compression sleeve 102 and the drag block/slip sub 127. This forces the mechanical slips 116 outwardly into biting engagement with the well casing 12, arresting further downhole movement of the lower packer element compression sleeve 102. Meanwhile, the operator continues to apply downhole pressure on the completion string until the weight gauge reads about—10,000 pounds, which urges the upper packer element compression sleeve 70 against the upper packer element 78. As the upper packer element 78 compresses into sealing contact with the well casing 12, it urges the flow activation sleeve 80 against the floating packer element compression ring 98, which compresses the lower packer element 100 into sealing contact with the well casing 12. Meanwhile, the lower end of the multicomponent mandrel 14 connected to the initial set sub mandrel component 96 is being forced downhole, which slides the lower unload sub mandrel component 136 into the initial set condition, closing the lower unload sub mandrel ports 137, and the straddle packer 10 is ready to be shifted to the operational condition in which focused fracturing can be accomplished.

Figure 4:
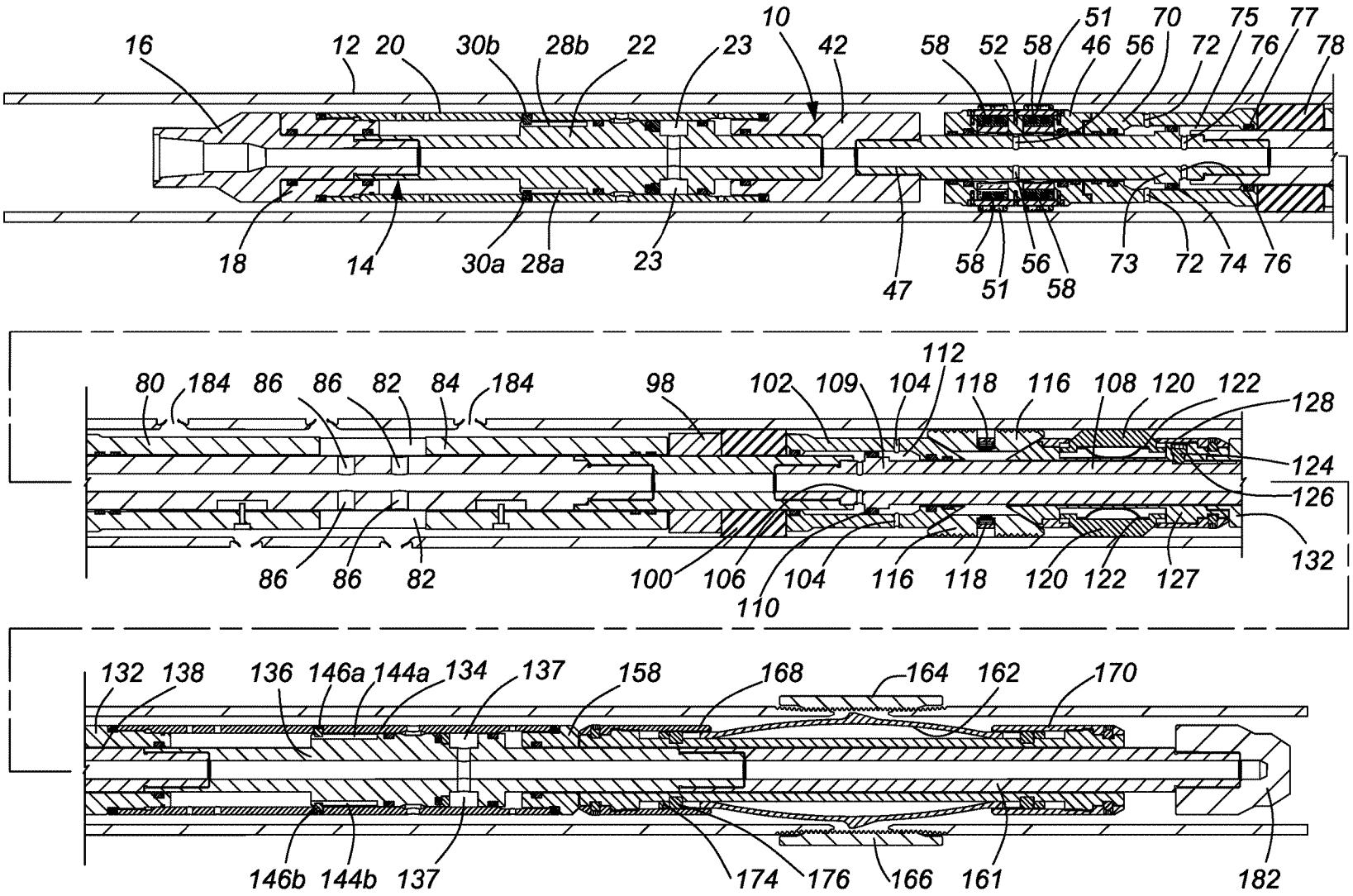
FIG. 4 is a cross-sectional view of the embodiment of a straddle packer shown in FIG. 1 in an operational condition.

FIG. 4 is a cross-sectional view of one embodiment of the straddle packer 10 shown in FIG. 1 in an operational condition. Once the, straddle packer 10 has been placed in the initial set position as described above, frac fluid is pumped down the completion string 11. As the upper unload sub mandrel ports 23 and the lower unload sub mandrel ports 137 are closed, frac fluid pressure builds within the multicomponent mandrel 14 and fluid is forced through the flow activation mandrel ports 86, the hydraulic slip pressure ports 56, the upper packer element piston ports 76 and the lower packer element piston ports 106. The fluid flow through the hydraulic slip pressure ports 56 urges hydraulic slips 51 outwardly into biting contact with the well bore casing 12 anchoring the uphole end of the straddle packer 10. Any time after the fluid pressure reaches a predetermined threshold, for example, 1,000 psi, the operator may relax downhole thrust on the completion string 11, if desired. As the fracturing fluid pressure is increased to a target fluid pressure which may be, for example, 8,000 psi, or any other fluid pressure planned for the fracturing operation, fluid flowing through the upper packer element piston ports 76 and the lower packer element piston ports 106 urges the upper packer element compression sleeve 70 towards the lower packer element compression sleeve 102, and vice-versa. This further compresses the upper packer element 78 and the lower packer element 100 for a more secure fluid seal against the well casing 12. Consequently, the greater the frac fluid pressure, the greater the sealing pressure boost and the more secure the seal provided by the upper packer element 78 and the lower packer element 100. After the upper packer element 78 and the lower packer element 100 are set, the only fluid path is through the flow activation mandrel ports 86, and subsequently through perforations 184 in the well casing 12.

After the focused fracturing of the selected area of the cased well bore is completed, fracturing fluid pumping is stopped and the completion string 11 is pulled up to begin a shift of the auto-J ratchet to the neutral notch 126*a*. Pulling up on the work string also moves the straddle packer 10 to the fluid unload position shown in FIG. 2 and opens the upper unload sub mandrel ports 23 and the lower unload sub mandrel ports 137, allowing fluid to drain from the straddle packer 10 which relaxes the upper packer element 78 and lower packer element 100 and releases the hydraulic slips 51 and the mechanical slips 116 from engagement with the well bore casing 12. Further manipulating the completion string 11 by pushing it down shifts the auto-J ratchet to the neutral notch 126*a*. The straddle packer 10 may then be moved to a new location in the well bore or removed from the well bore.

In an event that the formation around the well bore casing 12 stops accepting fracturing fluid proppant and proppant backs up into the straddle packer 10, a condition commonly referred to as a "screen-out", pumping is stopped and the completion string 11 is pulled up to open the upper unload sub mandrel ports 23 and the lower unload sub mandrel ports 137, as described above. Clean fluid can then be pumped down the completion string 11 to flush proppant out of the straddle packer 10 through the upper unload sub mandrel ports 23 and the lower unload sub mandrel ports 137, which will allow the upper packer element 78 and the lower packer element 100 to unset, freeing the straddle packer 10 so it can be moved to a new location or removed from the well bore.

Figure 5A:
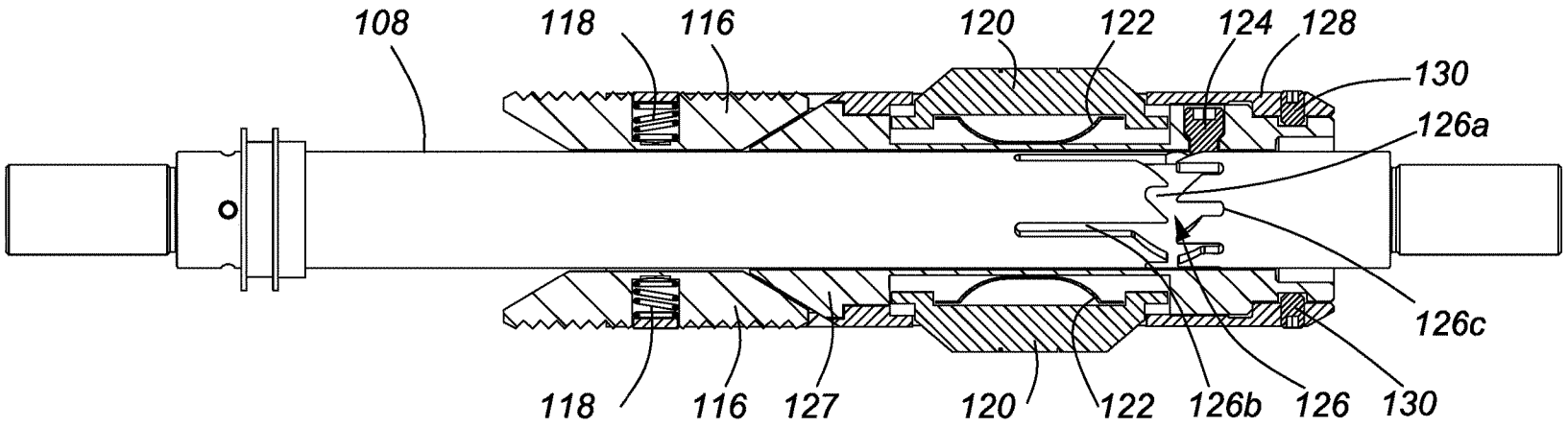
FIG. 5*a* is a schematic detailed view in partial cross-section of an auto-j ratchet of the straddle packer shown in FIG. 1 in the fluid-unload position.

FIG. 5*a* is a schematic detailed view in partial cross-section of the auto-j ratchet 126 of the straddle packer 10 shown in FIG. 1 in the fluid-unload position in which the auto-J ratchet lug 124 is in a neutral notch 126*a*. In the fluid-unload position, the upper unload sub mandrel ports 23 and the lower unload sub mandrel ports 137 are aligned with corresponding ports in the respective upper unload sub sleeve 20 and lower unload sub sleeve 134, permitting any fluid in the completion string 11 to drain from the straddle packer 10. The mechanical slips 116 and the hydraulic slips 51 are retracted and the tool can be pushed downhole against the resistance of the drag blocks 120.

Figure 5B:
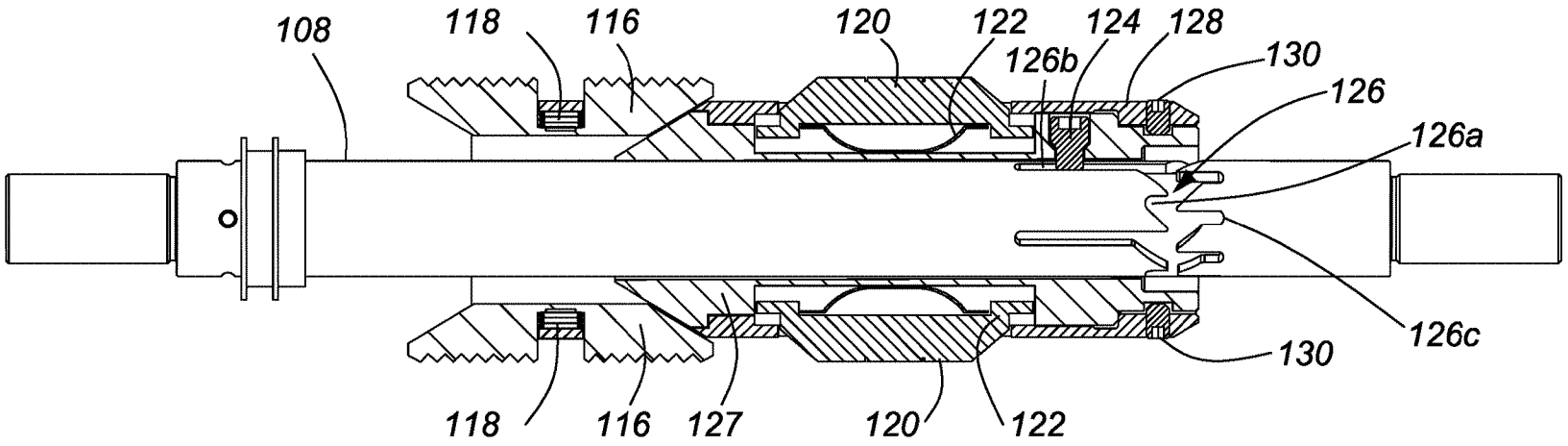
FIG. 5*b* is a schematic detailed view in partial cross-section of the auto-j ratchet of the straddle packer shown in FIG. 1 in the operational position.

FIG. 5*b* is a schematic detailed view in partial cross-section of the auto-j ratchet 126 of the straddle packer 10 shown in FIG. 1 with the auto-J ratchet lug 124 in a slip engage notch 126*b*. When the auto-J ratchet lug 124 enters the slip engage notch 126*b*, multicomponent mandrel 14 can be pushed downhole through the straddle packer 10, which closes the upper unload sub mandrel ports 23 and the lower unload sub mandrel ports 137, sets the mechanical slips 116 and compresses the upper packer element 78 and the lower packer element 100 to the initial set position, as described above with reference to FIG. 3. Shifting from the auto-J ratchet neutral notch 126*a* to the auto-J ratchet slip engage notch 126*b*, or vice versa, is accomplished by pulling up on the work string 11, which moves the auto-J ratchet lug 124 into an auto-J ratchet shift notch 126*c*. A subsequent downward push on the completion string 11 moves the auto-J ratchet to a subsequent notch of the auto-J ratchet 126. The shift occurs automatically and without any action required on the part of the operator aside from the required pull up on the completion string 11 followed by a push down on the completion string 11.

The explicit embodiments of the invention described above have been presented by way of example only. The scope of the invention is therefore intended to be limited solely by the scope of the appended claims.

I claim:

1. A cased bore straddle packer comprising:

a multicomponent mandrel that extends from an upper end to a lower end of the cased bore straddle packer, the multicomponent mandrel having a completion string connection mandrel component at the upper end of the straddle packer to permit the connection of a completion tubing string to the straddle packer, an upper packer element mandrel component with an upper packer element piston, and a lower packer element piston mandrel component with a lower packer element piston;

an upper packer element adapted to surround the multicomponent mandrel uphole of a flow activation mandrel component and a lower packer element adapted to surround the multicomponent mandrel downhole the flow activation mandrel component;

an upper packer element compression sleeve uphole of the upper packer element, the upper packer element compression sleeve adapted to reciprocate on the upper packer element mandrel component, and a lower packer element compression sleeve adapted to reciprocate on the lower packer element piston mandrel component downhole the lower packer element;

an auto-J ratchet groove in the multicomponent mandrel downhole of the lower packer element, the auto-J rachet groove having a slip engage notch adapted to permit string weight on the completion tubing string to force the multicomponent mandrel downhole to urge the upper packer element to an initial set condition and the lower packer element to the initial set condition;

an upper packer element piston port downhole of the upper packer element piston adapted to permit fluid pumped through the completion string to enter an upper packer element piston chamber and urge the upper packer element compression sleeve to boost compression of the upper packer element when high pressure fluid is pumped into the cased bore straddle packer; and a lower packer element piston port in the lower packer element piston component to permit the pumped fluid to enter a lower packer element piston chamber to urge the lower packer element compression sleeve to boost compression of the lower packer element.

2. The cased bore straddle packer as claimed in claim 1 further comprising a set of mechanical slips downhole of the lower packer element compression sleeve, and a downhole end of the lower packer element compression sleeve provides an uphole slip ramp for urging the set of mechanical slips to a set condition in which the mechanical slips bite a casing of the cased bore.

3. The cased bore straddle packer as claimed in claim 2 further comprising a drag block slip sub downhole of the mechanical slips, the drag block slip sub providing a downhole slip ramp for urging the mechanical slips to the set condition.

4. The cased bore straddle packer as claimed in claim 3 wherein the drag block slip sub supports the auto-J ratchet lug.

5. The cased bore straddle packer as claimed in claim 3 further comprising a set of drag blocks adapted to engage the casing to provide frictional resistance to movement of the cased bore straddle packer within the cased bore, to permit the auto-J latch to be shifted from the neutral notch position to the slip engage notch position and vice versa, the drag blocks being supported by the drag block slip sub.

6. The cased bore straddle packer as claimed in claim 1 further comprising a hydraulic slip sub connected to an uphole end of the upper packer element compression sleeve, the hydraulic slip sub reciprocating on the upper packer element compression piston mandrel component of the multicomponent mandrel which includes hydraulic slip pressure ports that permit the fluid pumped through the completion string to urge hydraulic slips of the hydraulic slip sub into biting contact with the casing of the cased bore.

7. The cased bore straddle packer as claimed in claim 6 further comprising hydraulic slip springs that urge the hydraulic slips to a normally unset condition.

8. The cased bore straddle packer as claimed in claim 1 further comprising:

an upper unload sub sleeve with fluid ports that are selectively aligned with corresponding upper unload sub mandrel ports in an upper unload sub mandrel component of the multicomponent mandrel;

a lower unload sub sleeve with fluid ports that are selectively aligned with corresponding lower unload sub mandrel ports in a lower unload sub mandrel component of the multicomponent mandrel.

9. The cased bore straddle packer as claimed in claim 8 wherein an uphole end of the upper unload sub mandrel component and a downhole end of the lower unload sub mandrel component respectively include anti-rotation slots and the upper unload sub sleeve and the lower unload sub sleeve include anti-rotation lugs that engage the respective anti-rotation slots to inhibit rotation of the upper unload sub mandrel component with respect to the upper unload sub sleeve and rotation of the lower unload sub mandrel component with respect to the lower unload sub sleeve.

10. The cased bore straddle packer as claimed in claim 1 further comprising a collar locator at a downhole end of the cased bore straddle packer to permit an operator of the cased bore straddle packer to detect casing collars in the cased bore.

11. The cased bore straddle packer as claimed in claim 1 further comprising a straddle packer guide cap connected to a downhole end of the multicomponent mandrel.

12. A cased bore straddle packer, comprising:

a multicomponent mandrel that extends from an uphole end to a downhole end of the cased bore straddle packer, the multicomponent mandrel having a completion string connection mandrel component at an uphole end of the cased bore straddle packer to permit the connection of a completion tubing string to the cased bore straddle packer;

an upper packer element uphole of a flow activation mandrel component of the multicomponent mandrel and a lower packer element down hole of the flow activation mandrel component;

an upper packer element compression sleeve adjacent an uphole end of the upper packer element, the upper packer element compression sleeve being adapted to reciprocate over an upper packer element compression piston on an upper packer element mandrel component of the multicomponent mandrel, and a lower packer element compression sleeve adjacent a downhole end of the lower packer element, the lower packer element compression sleeve being adapted to reciprocate over a lower packer element compression piston of a lower packer element compression piston mandrel component of the multicomponent mandrel; and an auto-j ratchet with an auto-J ratchet lug that engages an auto-J ratchet groove in the multicomponent mandrel, having neutral notch positions in which mechanical slips are in an unset condition and the upper and lower packer elements are respectively in relaxed conditions, interleaved with slip engage notch positions in which the mechanical slips are moved to a set condition and the upper and lower packer elements are compressed into contact with a casing of the cased well bore in an initial set condition when string weight is applied to the completion tubing string.

13. The cased bore straddle packer as claimed in claim 12 further comprising a set of drag blocks below the mechanical slips, the drag blocks being adapted to engage the casing and provide frictional resistance to movement of the straddle packer, to permit the auto-J ratchet to be shifted from the neutral notch position to the slip engage notch position by manipulation of the completion tubing string.

14. The cased bore straddle packer as claimed in claim 12 further comprising an upper unload sub uphole of the upper packer element compression sleeve and a lower unload sub downhole of the lower packer element compression sleeve, the upper unload sub and the lower unload sub respectively having fluid ports adapted to provide fluid communication between a central passage of the multicomponent mandrel and an annulus of a cased well bore when the auto-j ratchet lug is in the neutral notch position.

15. The cased bore straddle packer as claimed in claimed 12 further comprising a floating packer element compression sleeve that reciprocates on the multicomponent mandrel between a downhole end of the flow activation sleeve and an uphole end of the lower packer element.

16. The cased bare straddle packer as claimed in claim 12 further comprising a hydraulic slip sub connected to an uphole end of the upper packer element compression sleeve, the hydraulic slip sub comprising hydraulic slips with hydraulic slip springs that urge the hydraulic slips to a normally unset condition, the hydraulic slip sub being adapted to reciprocate on the upper packer element mandrel component of the multicomponent mandrel, which comprises hydraulic slip pressure ports that, permit high pressure fluid pumped through the completion string to urge the hydraulic slips into biting contact with the casing of the cased bore.

17. The cased bore straddle packer as claimed in claim 12 further comprising a collar locator on a downhole end of the multicomponent mandrel.

18. A cased bore straddle packer, comprising:

a multicomponent mandrel that extends from an uphole end to a downhole end of the cased bore straddle packer, the multicomponent mandrel having a completion string connection mandrel component at an uphole end of the cased bore straddle packer to permit the connection of a completion tubing string to the cased bore straddle packer;

an auto-j ratchet with an auto-J ratchet lug that engages an auto-J ratchet groove in the multicomponent mandrel having neutral notch positions, in which mechanical slips are in an unset condition and upper and lower packer elements are in relaxed conditions, interleaved with slip engage notch, positions, in which the mechanical slips are urged to a set condition and the upper and lower packer elements are compressed into contact with a casing of the cased well bore in an initial set condition when string weight is applied to the completion tubing string; and an upper packer element compression sleeve adjacent an uphole end of an upper packer element, the upper packer element compression sleeve being adapted to reciprocate over an upper packer element compression piston on an upper packer element mandrel component of the multicomponent mandrel to boost compression of the upper packer element in response to fluid pressure pumped through the completion string, and a lower packer element compression sleeve adjacent a downhole end of a lower packer element, the lower packer element compression sleeve being adapted to reciprocate over a lower packer element compression piston of a lower packer element piston mandrel component of the multicomponent mandrel to boost compression of the lower packer element in response to the fluid pressure pumped through the completion string.

19. The cased bore straddle packer as claimed in claim 18 further comprising an upper unload sub sleeve adapted to reciprocate on an upper unload sub mandrel component of the multicomponent mandrel and a lower unload sub sleeve adapted to reciprocate on a lower unload sub mandrel component of the multicomponent mandrel, the upper unload sub sleeve having fluid ports that are aligned with corresponding fluid ports in the upper unload sub mandrel component only when the auto-j ratchet lug is in a neutral notch position and the lower unload sub sleeve having fluid ports that are aligned with corresponding fluid ports in the lower unload sub mandrel component only when the auto-j ratchet lug is in the neutral notch position.

20. The cased bore straddle packer as claimed in claim 19 further comprising hydraulic slips adapted to be urged into biting contact with a casing of the cased well bore in response to the fluid pressure pumped through the completion tubing string.

* * * * *